US007033039B2

(12) United States Patent
Lin

(10) Patent No.: US 7,033,039 B2
(45) Date of Patent: Apr. 25, 2006

(54) TRASH STORAGE APPARATUS

(76) Inventor: Tsong-Yow Lin, No. 57-1, Yung Ho Street, Yung Ho Village, Ta Tu Hsiang, Taichung Hsien (TW)

( * ) Notice: Subject to any disclaimer, the term of this patent is extended or adjusted under 35 U.S.C. 154(b) by 206 days.

(21) Appl. No.: 10/459,953

(22) Filed: Jun. 12, 2003

(65) Prior Publication Data

US 2004/0252490 A1 Dec. 16, 2004

(51) Int. Cl.
*F21V 33/00* (2006.01)
*F21V 9/16* (2006.01)
*B65D 43/26* (2006.01)

(52) U.S. Cl. ..... 362/154; 362/84; 362/276; 220/263; 220/908

(58) Field of Classification Search ..... 362/84, 362/154, 155, 276, 802; 220/263, 908; 40/567, 40/549

See application file for complete search history.

(56) References Cited

U.S. PATENT DOCUMENTS

| | | | | |
|---|---|---|---|---|
| 966,145 | A | 8/1910 | Wilder | |
| 1,189,592 | A * | 7/1916 | Lutz | 362/155 |
| 1,237,016 | A | 8/1917 | Brown | |
| 1,265,148 | A | 5/1918 | Warren | |
| 1,379,677 | A | 5/1921 | Brunhoff | |
| 1,461,253 | A | 7/1923 | Owen | |
| 1,507,040 | A | 9/1924 | Zifferer | 220/263 |
| 1,515,989 | A | 11/1924 | Banes | 220/264 X |
| 1,703,509 | A | 2/1929 | Chandlee | |
| 1,799,621 | A | 4/1931 | Shaw | |
| 1,816,974 | A * | 8/1931 | Kavanagh | 40/567 |
| 1,820,555 | A | 8/1931 | Buschman | |
| 1,881,120 | A | 10/1932 | Fessler et al. | |
| 1,891,651 | A | 12/1932 | Padelford et al. | |
| 1,966,323 | A | 7/1934 | Von Elm | 220/263 |
| 2,016,558 | A | 10/1935 | Redrup | |
| D102,512 | S | 12/1936 | Stallings et al. | |
| 2,096,578 | A | 10/1937 | Flanagan | |
| D108,642 | S | 3/1938 | Geisel | |
| 2,170,604 | A | 8/1939 | Creesy et al. | |
| D118,374 | S | 1/1940 | Kamenstein | |
| 2,195,033 | A | 3/1940 | Lehman | |
| D120,270 | S | 4/1940 | Martinez | |
| 2,216,279 | A | 10/1940 | Packer | |
| 2,242,698 | A | 5/1941 | Evitt | |
| 2,246,975 | A | 6/1941 | Geibel | 220/264 X |
| 2,255,972 | A | 9/1941 | Harvard | |
| 2,308,398 | A | 1/1943 | Stevens | |
| 2,311,835 | A | 2/1943 | Johnson | |
| D145,970 | S | 11/1946 | Bloomfield | |
| D147,646 | S | 10/1947 | Footlik | |
| D151,986 | S | 12/1948 | Hamilton | |
| 2,475,125 | A | 7/1949 | Brownell | |

(Continued)

FOREIGN PATENT DOCUMENTS

| | | |
|---|---|---|
| DE | 4313557 | 10/1994 |

(Continued)

*Primary Examiner*—Y. My Quach-Lee
*Assistant Examiner*—Peggy A. Neils
(74) *Attorney, Agent, or Firm*—Alan D. Kamrath; Nikolai & Mersereau, P.A.

(57) ABSTRACT

A trash storage apparatus includes a can, an illuminating element and a driver. The can is used for receiving garbage. The illuminating element is mounted on the can. The driver is used for driving the illuminating element to shine in the dark. The trash storage apparatus may include a lid for covering the can and a pedal connected with the lid. The illuminating element is attached to the pedal.

18 Claims, 8 Drawing Sheets

U.S. PATENT DOCUMENTS 2,543,008 A * 2/1951 French ..... 40/473
2,563,456 A 8/1951 Brownell
2,904,210 A 9/1959 Grossman
2,907,491 A 10/1959 Gunn
2,910,206 A 10/1959 Hodgson
2,920,338 A 1/1960 Falk ..... 16/66
D187,300 S 2/1960 Tupper
D187,305 S 2/1960 Leominster
D191,546 S 10/1961 Garner
D197,007 S 12/1963 Bringhton
3,450,297 A 6/1969 Clerk
3,866,791 A 2/1975 Roper et al.
D241,499 S 9/1976 Raftery
4,081,105 A 3/1978 Dagonnet et al. ..... 220/263
4,166,572 A 9/1979 Leeds ..... 232/1 R
D256,423 S 8/1980 Bacskay et al.
D261,720 S 11/1981 Brazis
4,361,247 A 11/1982 Williams ..... 220/88.1
4,363,417 A 12/1982 Rhoades et al.
4,442,478 A * 4/1984 Stansbury ..... 362/489
4,445,619 A 5/1984 Kubic et al.
4,473,170 A 9/1984 Ciancimino
4,489,810 A 12/1984 Curtis
4,577,262 A * 3/1986 Buteaux ..... 362/155
4,785,964 A 11/1988 Miller et al. ..... 220/263
4,827,645 A * 5/1989 Stamps, Jr. ..... 40/567
4,877,226 A 10/1989 Taylor ..... 267/196
4,902,482 A 2/1990 Faust ..... 422/121
4,913,308 A 4/1990 Culbertson ..... 220/263
4,953,744 A 9/1990 Koyama
D312,160 S 11/1990 Calvi
D319,905 S 9/1991 Hotchkiss
D321,575 S 11/1991 Corps
D322,350 S 12/1991 Craft, Jr. et al.
5,082,139 A 1/1992 Quam
D327,965 S 7/1992 Chelee
D328,510 S 8/1992 Brussing
5,136,476 A * 8/1992 Horn ..... 362/198
D329,929 S 9/1992 Knoedler et al.
5,142,738 A 9/1992 Ojima ..... 16/306
5,163,574 A 11/1992 Susan ..... 220/263
5,170,904 A 12/1992 Neuhaus ..... 220/263
D332,334 S 1/1993 Jones
D332,852 S 1/1993 Delmerico
D333,024 S 2/1993 Van Buiten
D333,025 S 2/1993 Doherty
D333,897 S 3/1993 Ward
D335,561 S 5/1993 Mihyar
D335,562 S 5/1993 Evans
5,211,269 A 5/1993 Ohshima ..... 188/290
5,230,525 A 7/1993 Delmerico et al. ..... 220/263
5,249,693 A 10/1993 Gillispie et al. ..... 220/263
5,263,209 A * 11/1993 Pattee ..... 4/661
5,269,087 A 12/1993 Johnston ..... 43/4
D343,486 S 1/1994 Kimport
5,295,607 A 3/1994 Chang ..... 220/263
5,350,079 A 9/1994 Larson et al.
5,356,025 A 10/1994 Renault
D352,144 S 11/1994 Brookshire et al.
D355,060 S 1/1995 Bernstein et al.
5,382,108 A 1/1995 Ojima ..... 403/120
5,440,978 A 8/1995 O'Brien et al. ..... 220/264 X
5,474,201 A 12/1995 Liu ..... 220/23.87
D368,563 S 4/1996 Brightbill et al.
5,531,348 A 7/1996 Baker et al. ..... 220/263
D377,554 S 1/1997 Adriaansen
D381,784 S 7/1997 Keller et al.
D393,334 S 4/1998 Presncll et al.
D401,028 S 11/1998 Ahern, Jr. et al.
5,842,595 A 12/1998 Williams
5,947,584 A * 9/1999 Passanante et al. ..... 362/154
5,960,983 A 10/1999 Chan
5,967,355 A 10/1999 Ragot ..... 220/4.32
D418,957 S 1/2000 Rashid
6,010,024 A 1/2000 Wang ..... 220/23.87
6,024,238 A 2/2000 Jaros ..... 220/264
D431,700 S 10/2000 Roudebush
D431,702 S 10/2000 McKeown et al.
D435,951 S 1/2001 Yang et al.
6,178,085 B1 1/2001 Leung ..... 361/683
D439,717 S 3/2001 Konieczny
6,206,281 B1 3/2001 Leung ..... 235/61 R
D441,160 S 4/2001 Lin
D442,330 S 5/2001 Cousins
D446,375 S 8/2001 Daams
D447,304 S 8/2001 Niemeyer
D447,308 S 8/2001 Lin
D447,611 S 9/2001 Lin
D450,901 S 11/2001 Lin
D453,252 S 1/2002 Lin
D453,253 S 1/2002 Lin
6,336,252 B1 1/2002 Bando ..... 16/307
D453,600 S 2/2002 Lin
D453,870 S 2/2002 Lin
6,345,725 B1 2/2002 Lin ..... 220/263
D454,239 S 3/2002 Lin
6,402,338 B1 * 6/2002 Mitzel et al. ..... 362/154
D460,595 S 7/2002 Lin
D465,629 S 11/2002 Lin
D465,630 S 11/2002 Lin
D465,893 S 11/2002 Lin
D465,894 S 11/2002 Lin
D466,265 S 11/2002 Lin
D466,667 S 12/2002 Lin
D467,696 S 12/2002 Rashid
D468,500 S 1/2003 Lin
6,510,588 B1 1/2003 Eromaki ..... 16/308
D470,639 S 2/2003 Quan
D472,686 S 4/2003 Lin
D472,687 S 4/2003 Lin
D472,688 S 4/2003 Lin
D476,126 S 6/2003 Lin
D476,128 S 6/2003 Lin
D476,458 S 6/2003 Lin
D476,460 S 6/2003 Lin
D476,788 S 7/2003 Lin
6,808,286 B1 * 10/2004 Backes et al. ..... 362/155
2002/0079315 A1 6/2002 Yang
2002/0092853 A1 7/2002 Wang
2003/0173369 A1 9/2003 Nikolaus et al. ..... 220/830
2003/0201265 A1 10/2003 Lin ..... 220/254.3
2003/0201267 A1 10/2003 Yang et al.
2003/0201268 A1 10/2003 Lin ..... 220/263
2004/0016756 A1 1/2004 Lin ..... 220/263

FOREIGN PATENT DOCUMENTS

EP 0611742 8/1994
GB 2402866 11/2005
JP 8067303 3/1996
JP 1199003 7/1999
JP 1315902 11/2001

* cited by examiner

TRASH STORAGE APPARATUS

FIELD OF INVENTION

The present invention relates to a trash storage apparatus.

BACKGROUND OF INVENTION

Taiwanese Patent publication No. 354560 discloses a trash storage apparatus including a can 1 and a lighting set 2. The lighting set 2 mounted on the can 1. The lighting set 2 can cast light onto the can 1 for illuminative and aesthetic purposes so that the can 1 is visible in the night. Hence, a user needs no time to search for the can 1. However, the lighting set 2 includes a bulb 24 that provides strong light and much heat. Thus, it is only suitable for outdoor use. The lighting set 2 is connected with an external power source by a wire 14. Since there is no switch, a user must pull the wire 14 from the external power source in order to turn off the lighting set 2. A user, however, often forgets to pull the wire 14 from the external power source so that the lighting set 2 continues to shine in the daytime. Thus, the bulb 24 wastes much energy.

The present invention is therefore intended to obviate or at least alleviate the problems encountered in the prior art.

SUMMARY OF INVENTION

It is the primary objective of the present invention to provide an energy-economic trash storage apparatus.

A trash storage apparatus includes a can, an illuminating element and a driver. The can is used for receiving garbage. The illuminating element is mounted on the can. The driver is used for driving the illuminating element to shine in the dark.

Other objectives, advantages, and novel features of the invention will become more apparent from the following detailed description when taken in conjunction with the attached drawings.

BRIEF DESCRIPTION OF THE DRAWINGS

The present invention will be described through detailed illustration of embodiments referring to the attached drawings.

DETAILED DESCRIPTION OF PREFERRED EMBODIMENT

Figure 1:
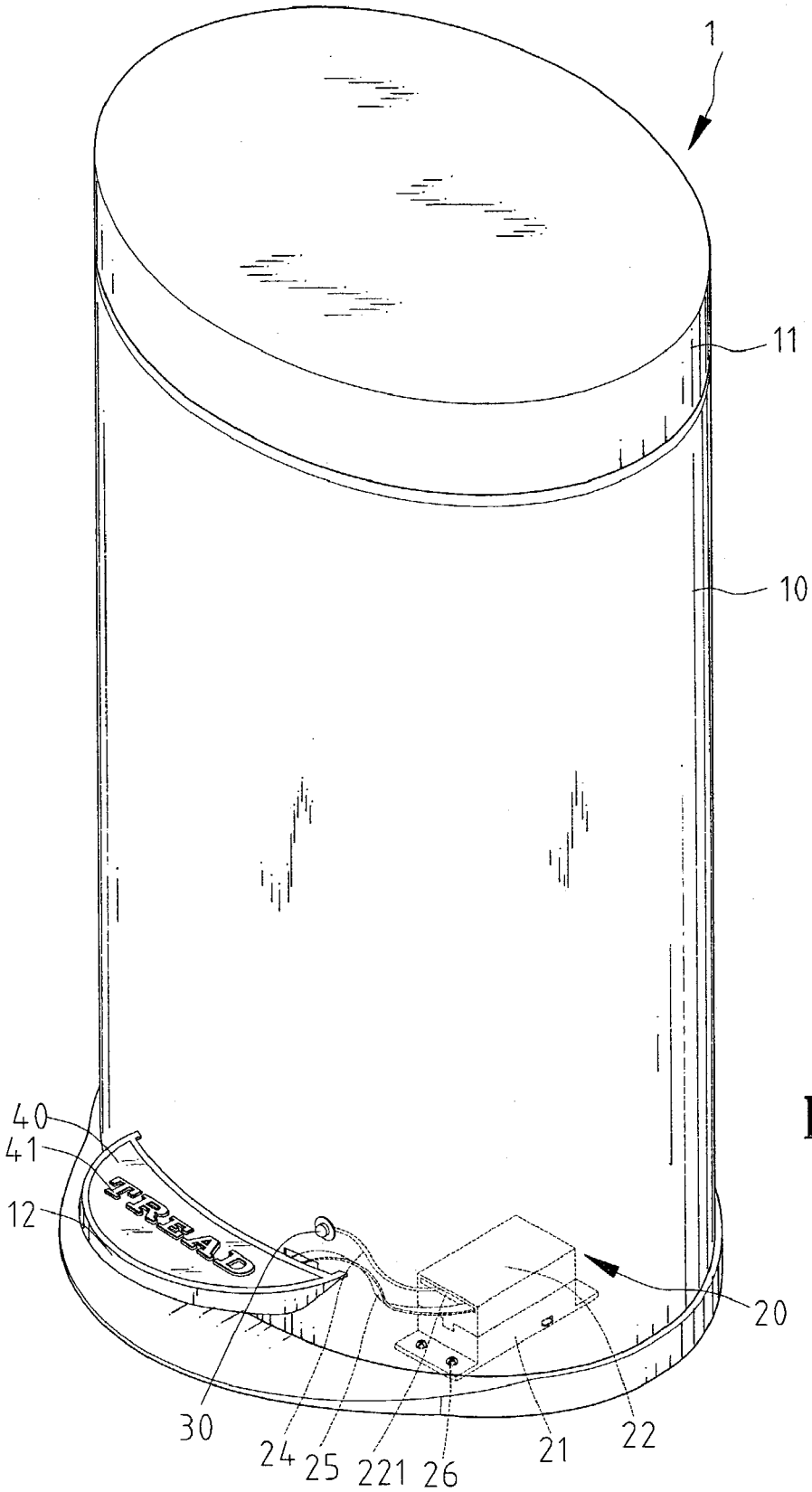
FIG. 1 is a perspective view of a trash storage apparatus according to a first embodiment of the present invention.
Figure 2:
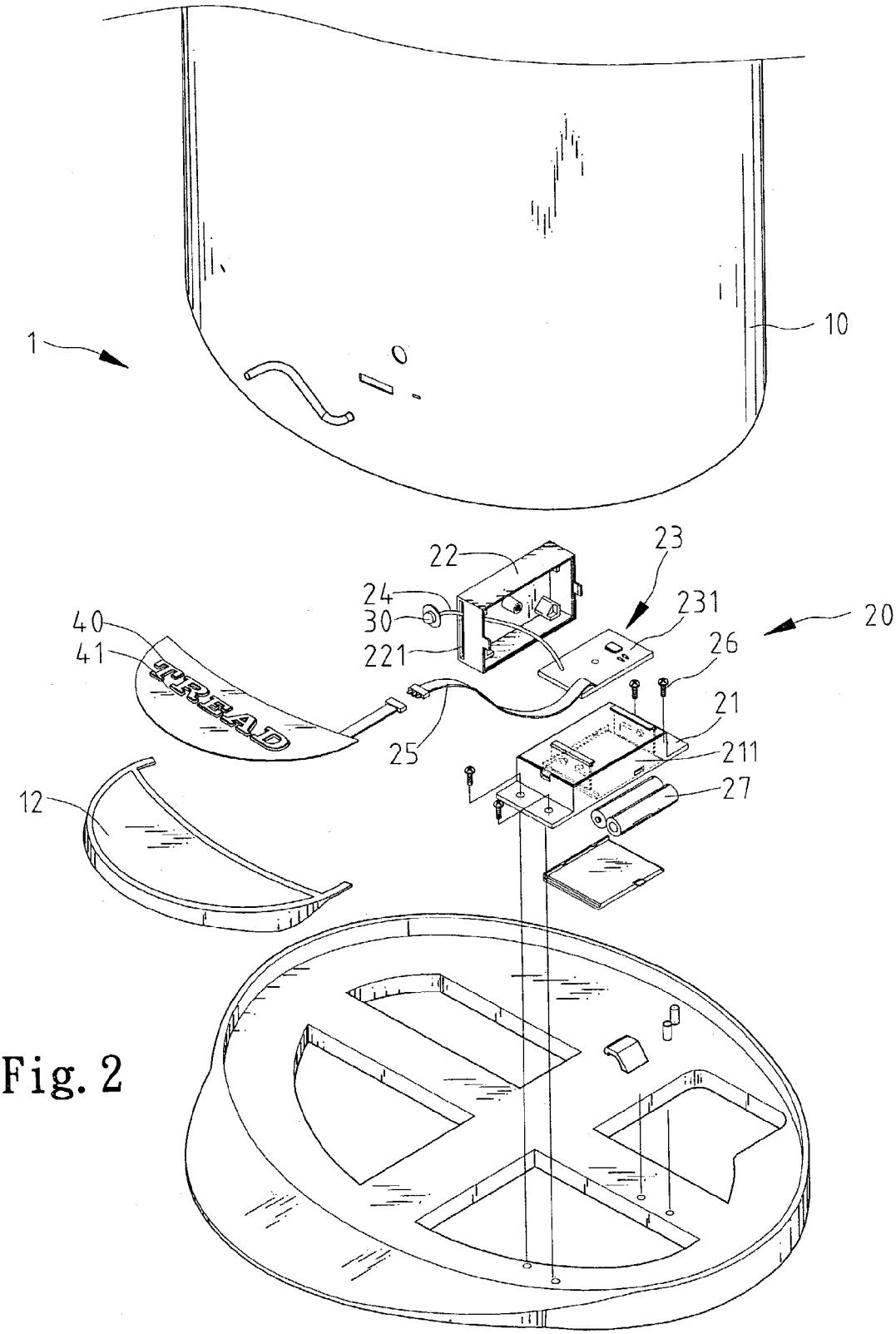
FIG. 2 is an exploded view of the trash storage apparatus shown in FIG. 1.
Figure 3:
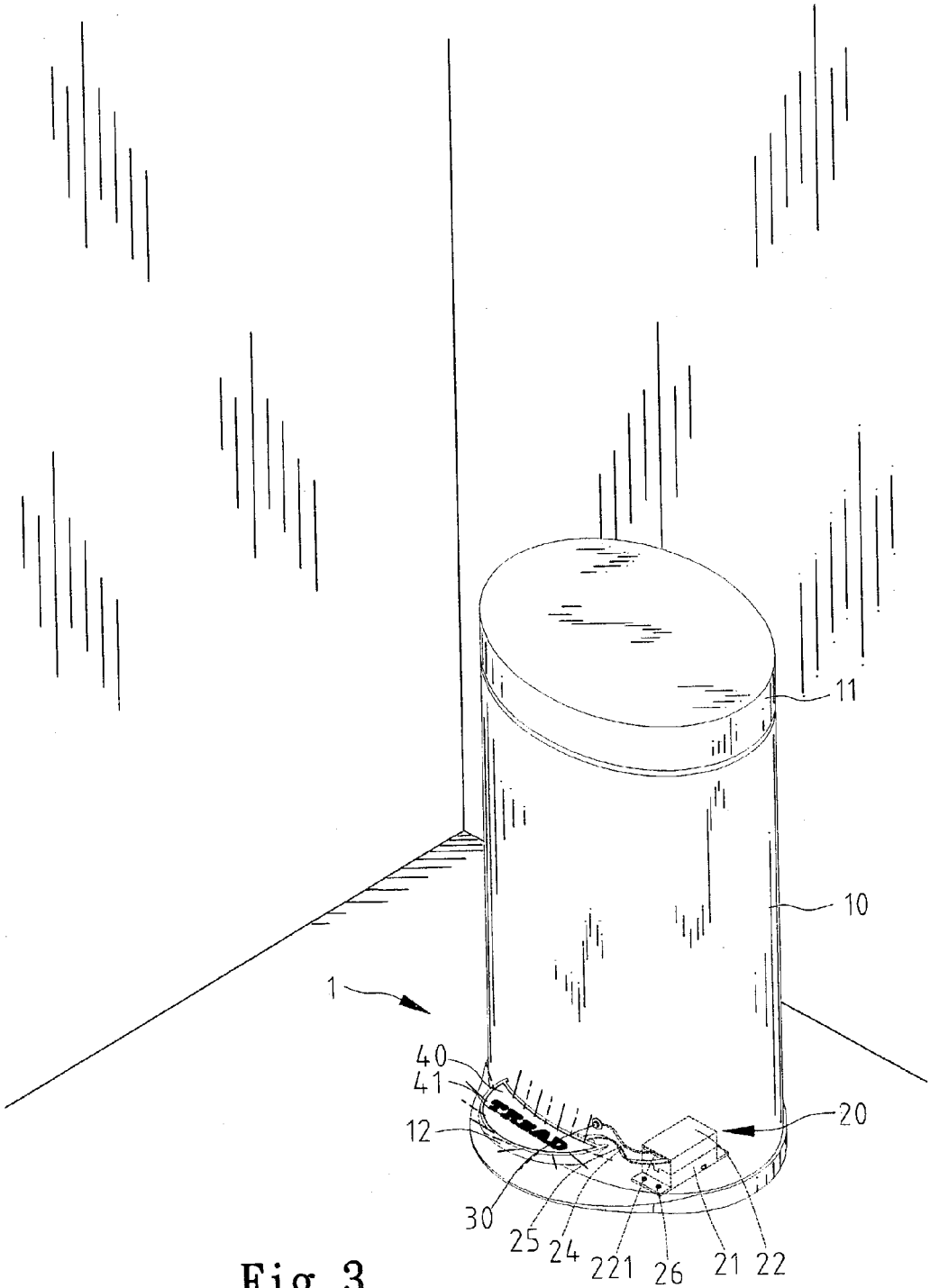
FIG. 3 is similar to FIG. 1 but showing the trash storage apparatus in the operative condition.

Referring to FIGS. 1~3, according to a first embodiment of the present invention, a trash storage apparatus 1 includes a can 10, a lid 11, a sensor 30, a driver 20, two wires 24 and 25, a pedal 12 and a luminescent element 40.

Referring to FIG. 1, the can 10 is used for receiving garbage. The lid 11 is mounted on the can 10. The sensor 30 is mounted on the can 10. The pedal 12 is connected with the lid 11. The illuminating element 40 is attached to the pedal 12. The illuminating element 40 is a luminescent element. The sensor 30 is connected with the driver 20 via a wire 24. The luminescent element 40 is connected with the driver 20 via a wire 25. The driver 20 is used for driving the luminescent element 40 to shine according to a signal transmitted from the sensor 30.

Referring to FIG. 2, the driver 20 includes a cover 22 and a box 21. The box 21 includes a control device 23. The box 21 is secured to the can 10 by bolts 26. A space 211 is defined in the box 21 for receiving a battery 27 that is connected with the control device 23. A slot 221 is defined in the cover 22. The wire 24 extends through the slot 221. The wire 25 extends through the slot 221. The control device 23 includes a circuit board 231. The circuit board 231 includes a central processing unit, a power source control unit and a signal-processing unit (not shown). How the circuit board 231 receives or transmits signal is conventional. The sensor 30 may be an optical sensor. As brightness in the environment is below a criterion, the optical sensor transmits a signal to the control device 23 for driving the luminescent element 40 to shine. On the contrary as the brightness in the environment is above the criterion, the control device 23 turns off the luminescent element 40. The luminescent element 40 is shaped according to the pedal 12. "Tread" may be printed or molded on the luminescent element 40. A luminescent element 41 may be shaped as "Tread." The central processing unit controls the luminescent elements 40 and 41 to shine by turns or simultaneously.

Referring to FIG. 3, when the brightness is below the criterion, the sensor 30 transmits the signal to the control device 23. The signal is processed by the control device 23 for driving the luminescent element 40 to shine so that the trash storage apparatus 1 is visible.

Figure 4:
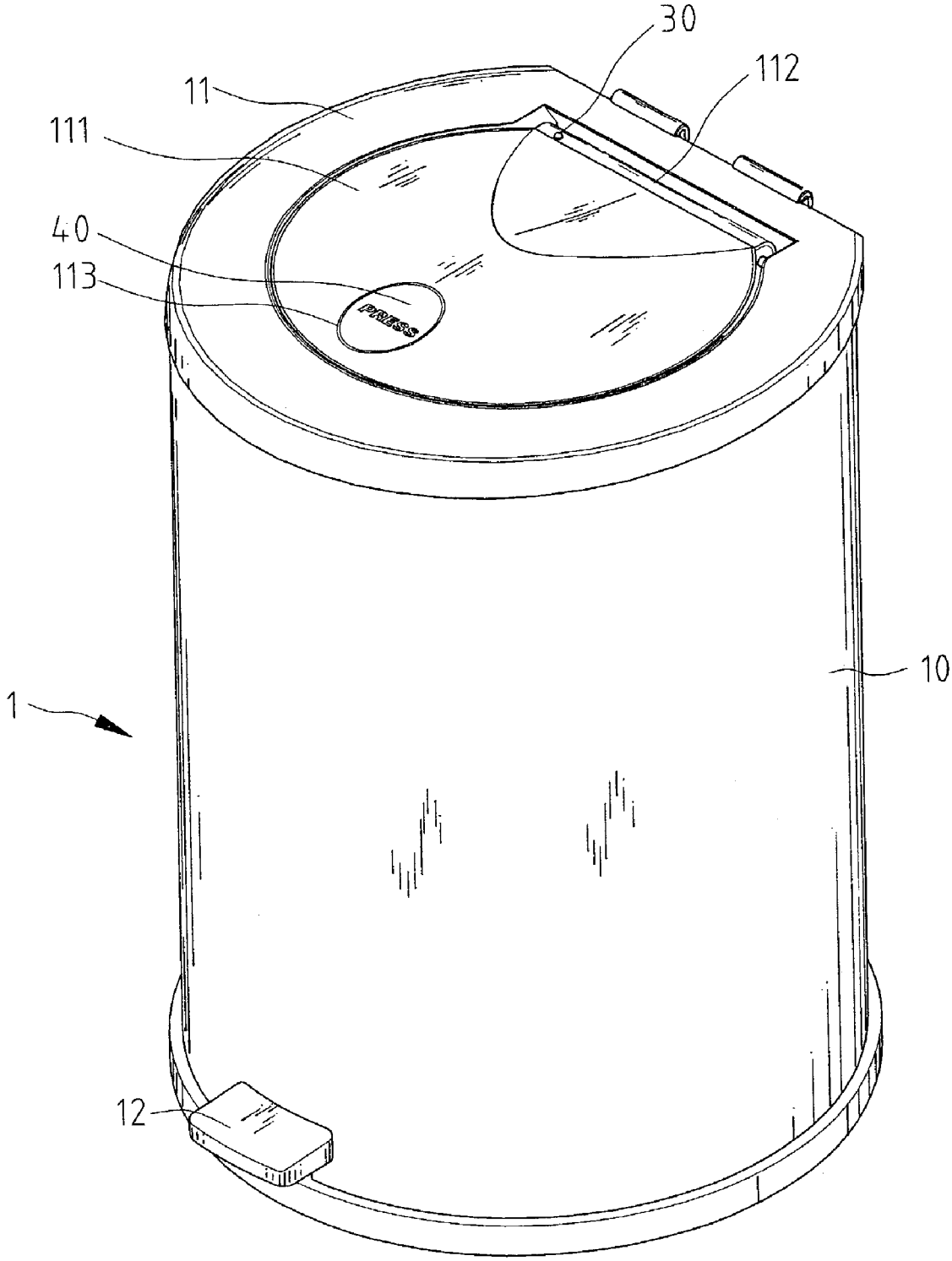
FIG. 4 is a perspective view of the trash storage apparatus according to a second embodiment of the present invention.
Figure 5:
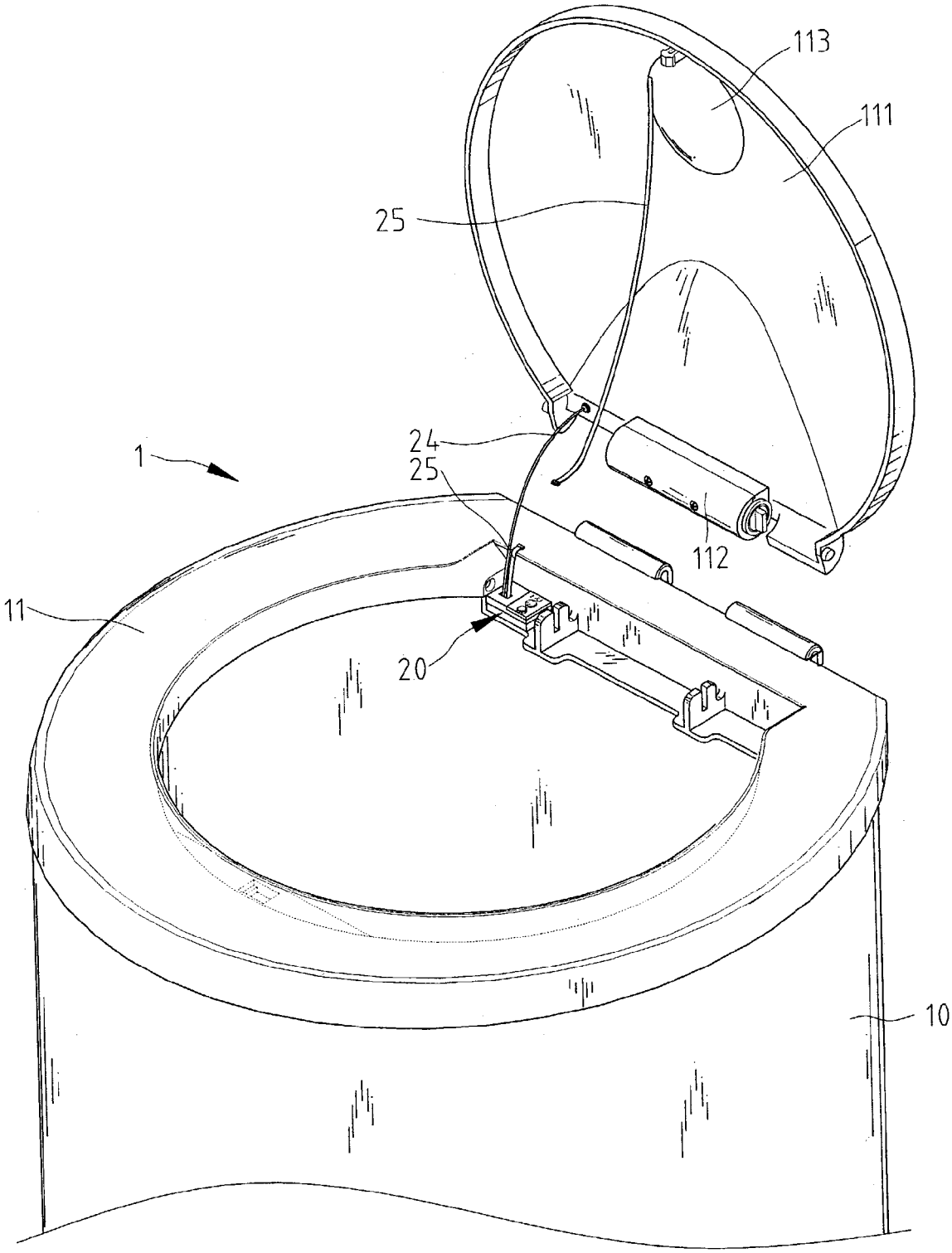
FIG. 5 is an exploded view of the trash storage apparatus shown in FIG. 4.

FIGS. 4 and 5 show a second embodiment according to the present invention. The trash storage apparatus 1 includes an annular lid 11 and a lid 111 located within the annular lid 11. An end of the lid 111 is pivotally connected with the annular lid 11 by a hinge/buffer assembly 112. The luminescent element 40 is mounted in a recess 113 on another end of the lid 111. Opening and closing of the annular lid 11 and the lid 111 are conventional and will not be described in detail. The driver 20 is mounted on the annular lid 11. The sensor 30 is mounted on the lid 111. The sensor 30 is connected with the driver 20 through the wire 24. The luminescent element 40 is connected with the driver 20 through the wire 25. Thus, when the brightness in the environment is below the criterion, the driver 20 drives the luminescent element 40 to shine.

Figure 6:
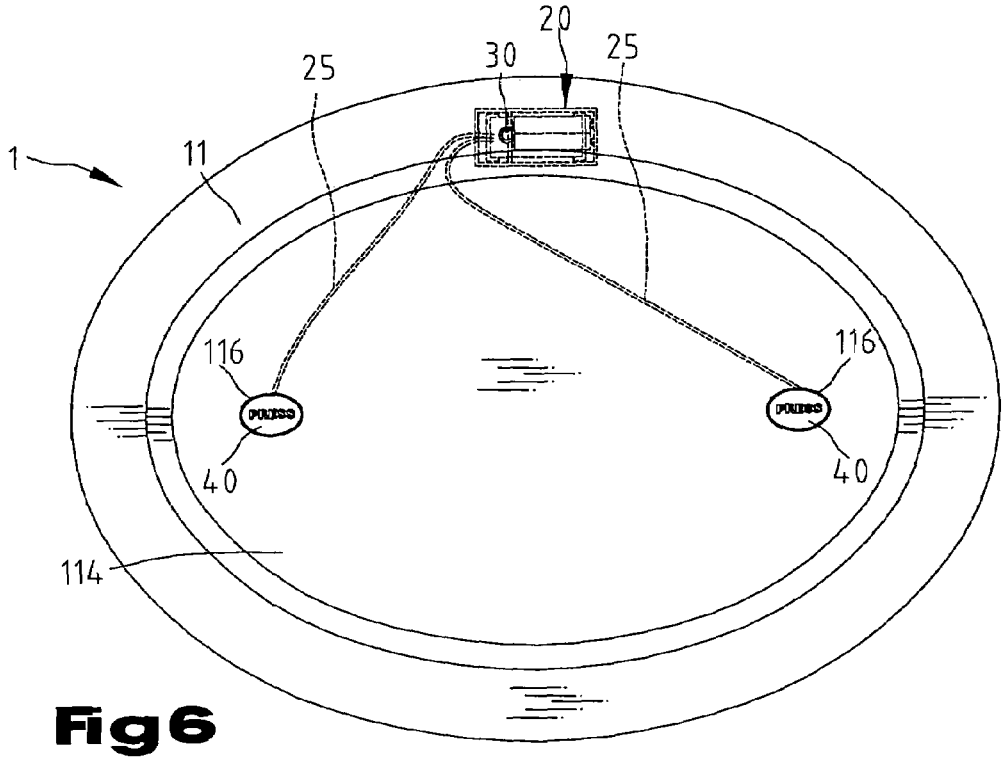
FIG. 6 is a top view of the trash storage apparatus according to a third embodiment of the present invention.
Figure 7:
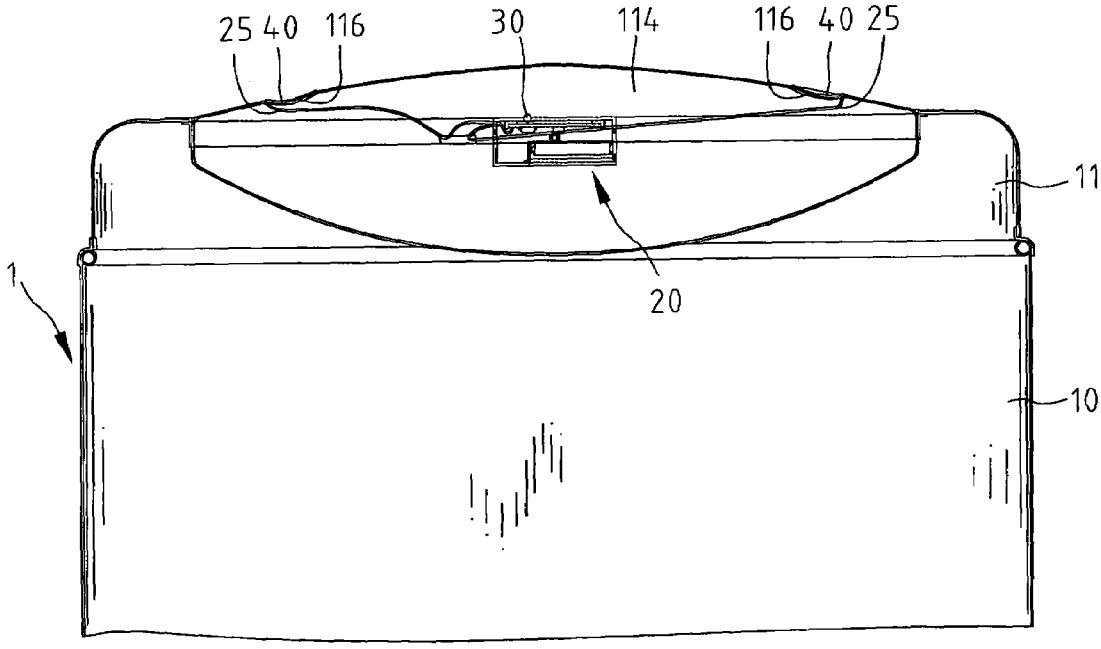
FIG. 7 is a side view of the trash storage apparatus shown in FIG. 6.

FIGS. 6 and 7 show a third embodiment according to the present invention. The trash storage apparatus 1 includes an annular lid 11 and a lid 114 located within the annular lid 11. An end of the lid 114 is pivotally connected with the annular lid 11. Two luminescent elements 40 are mounted in recess 116 on the lid 114. The driver 20 and the sensor 30 are mounted on the lid 11. The third embodiment is otherwise identical to the second embodiment.

Figure 8:
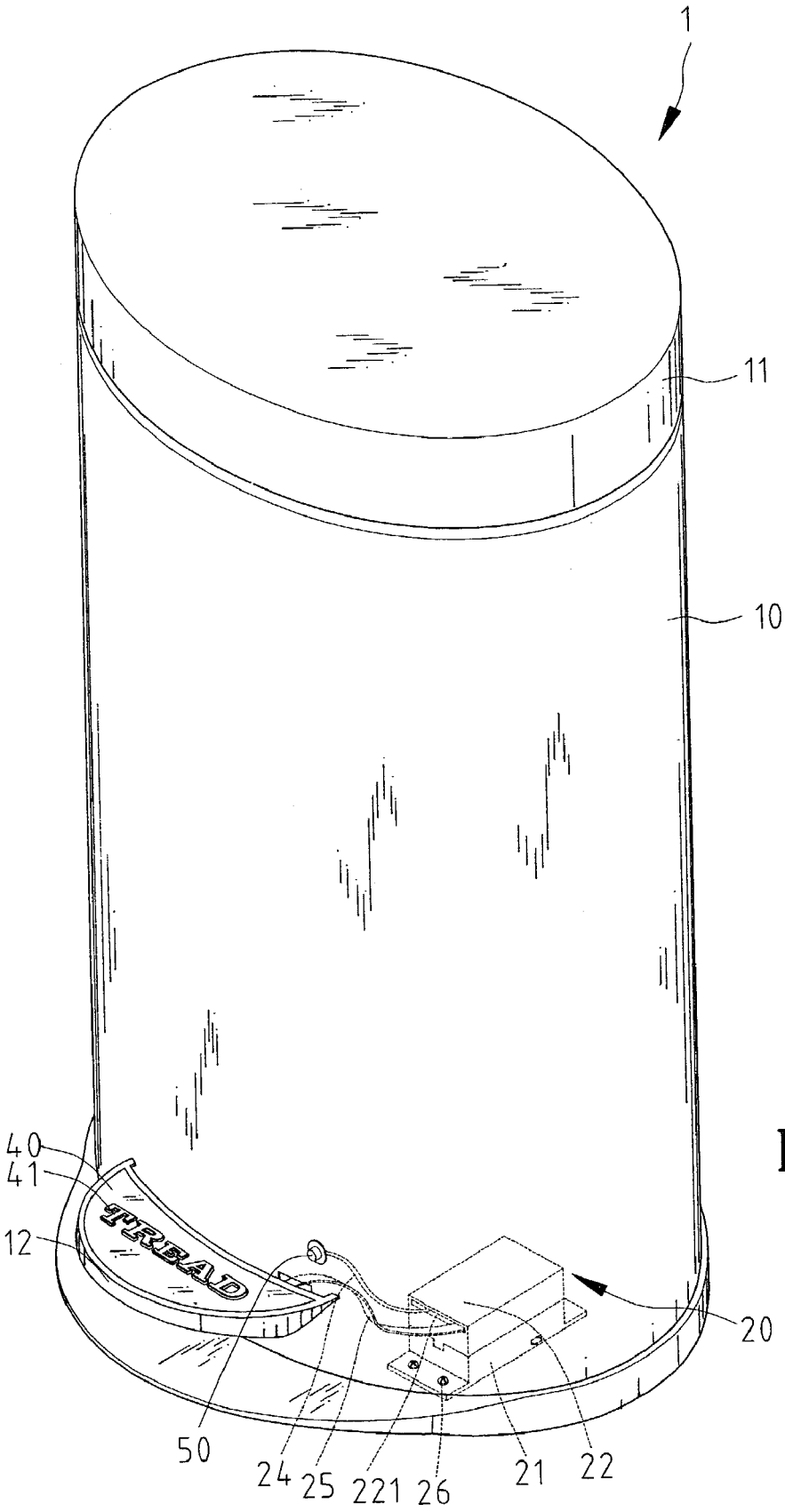
FIG. 8 is a perspective view of the trash storage apparatus according to a fourth embodiment of the present invention.

FIG. 8 shows a fourth embodiment according to the present invention. The sensor 30 of the first embodiment is replaced with a switch 50 in the fourth embodiment. Thus, when the brightness in the environment is insufficient, the user uses the switch 50 to turn on the illuminating element 40 to shine. Moreover, the circuit board 231 includes a timer (not shown). That is, times to turn on and off the luminescent element 40 can be set so that the luminescent element 40 illuminates for a set period of time.

Figure 9:
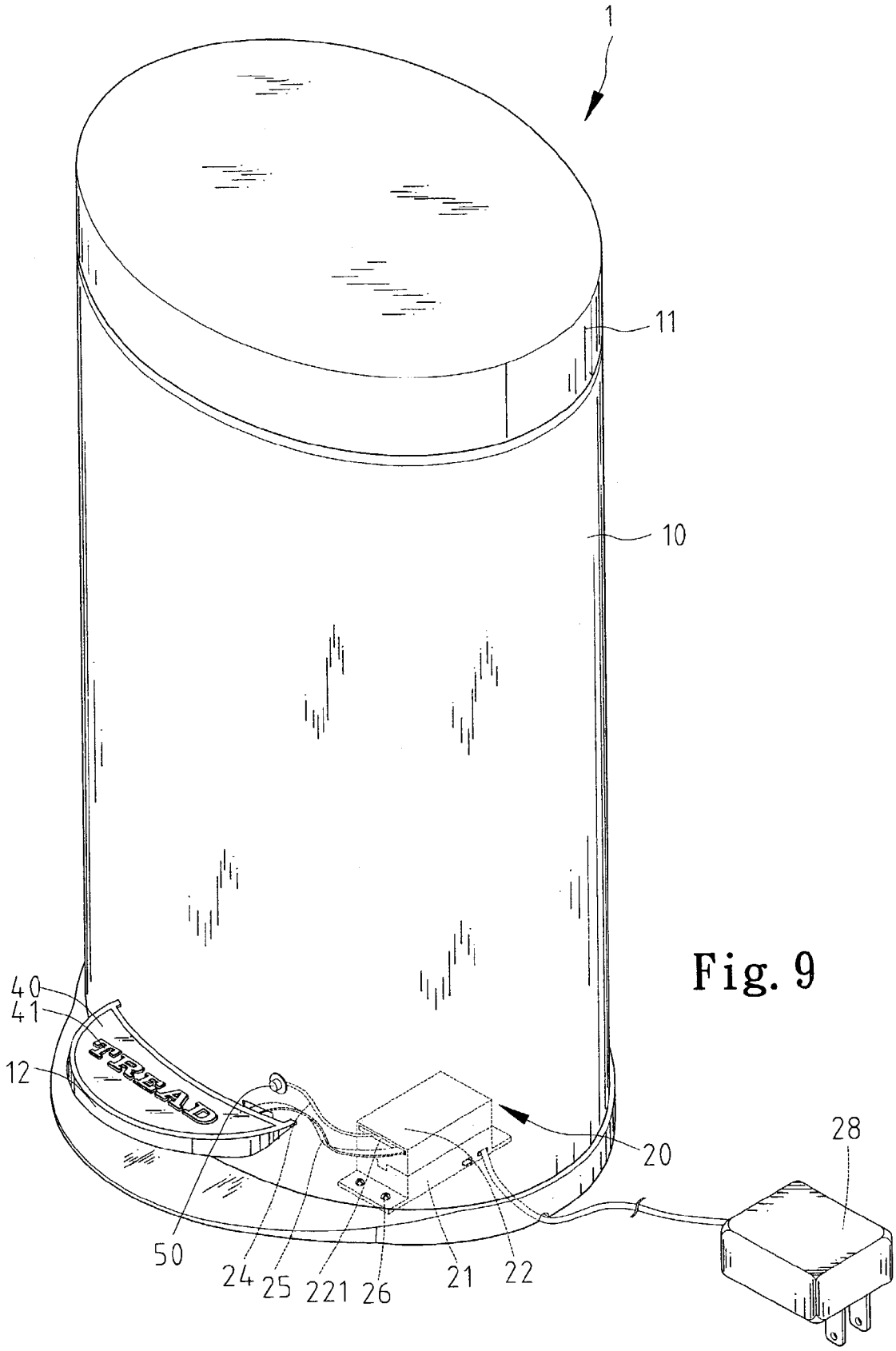
FIG. 9 is a perspective view of the trash storage apparatus according to a fifth embodiment of the present invention.

FIG. 9 shows a fifth embodiment according to the present invention. The driver 20 is provided with a transformer 28. The driver 20 can be connected with an external power source through the transformer 28.

The present invention has been described through detailed illustration of five embodiments. Those skilled in the art can derive variations from the embodiments without departing from the scope of the present invention. Therefore, the embodiments shall not limit the scope of the present invention defined in the claims.

What is claimed is:

1. A trash storage apparatus including:

a can for receiving garbage, with the can having a lid for covering the can;

an illuminating element mounted on the can;

a driver for driving the illuminating element to shine in the dark;

a sensor for sending a signal to the driver that in turn drives the illuminating element to shine; and a pedal connected with the lid, with the pedal opening the lid, wherein the illuminating element is attached to the pedal and visible outside of the can and the lid.

2. The trash storage apparatus according to claim 1 including a wire connected between the illuminating element and the driver.

3. The trash storage apparatus according to claim 1 wherein the driver includes a box, a cover for closing the box and at least one battery put in the box for powering the driver.

4. The trash storage apparatus according to claim 1 wherein the driver includes a transformer for connection with an alternating current power source.

5. The trash storage apparatus according to claim 1 wherein the driver drives the illuminating element to shine continuously.

6. The trash storage apparatus according to claim 1 wherein the driver drives the illuminating element to flash.

7. The trash storage apparatus according to claim 1 including another illuminating element located on the illuminating element.

8. The trash storage apparatus according to claim 7 wherein the driver drives the illuminating elements to shine synchronously.

9. The trash storage apparatus according to claim 7 wherein the driver drives the illuminating elements to shine by turns.

10. The trash storage apparatus according to claim 1 wherein the illuminating element is a luminescent element.

11. The trash storage apparatus according to claim 1 including a wire for connecting the sensor with the driver.

12. The trash storage apparatus according to claim 1 wherein the driver includes a circuit board including a central processing unit for processing and sending the signal.

13. The trash storage apparatus according to claim 1 further including a switch connected with the driver.

14. The trash storage apparatus according to claim 13 including a wire for connecting the switch with the driver.

15. The trash storage apparatus according to claim 13 wherein the illuminating element is a luminescent element.

16. A trash storage apparatus including:

a can for receiving garbage, with the can having a lid for covering the can;

an illuminating element mounted on the can;

a driver for driving the illuminating element to shine in the dark; and a sensor for sending a signal to the driver that in turn drives the illuminating element to shine, with the lid pivotable between a closed position covering the can and an open position allowing access to the can, with the lid being opened by pressing on the lid, with the illuminating element mounted on and outside the lid of the can.

17. The trash storage apparatus according to claim 16 including another illuminating element mounted on and outside the lid of the can and spaced from the illuminating element, with the illuminating elements located on a horizontal top of the lid of the can.

18. The trash storage apparatus according to claim 1 wherein the sensor is an optical sensor.

* * * * *